US011527834B1

(12) United States Patent
Safford et al.

(10) Patent No.: US 11,527,834 B1
(45) Date of Patent: Dec. 13, 2022

(54) BROADBAND SLOTTED ANTENNA

(71) Applicant: The United States of America as represented by the Secretary of the Navy, Newport, RI (US)

(72) Inventors: Susan M Safford, Jamestown, RI (US); David A Tonn, Charlestown, RI (US); Michael T Lanagan, State College, PA (US); Eugene Furman, State College, PA (US); Steven E Perini, State College, PA (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/501,028

(22) Filed: Oct. 14, 2021

(51) Int. Cl.
*H01Q 13/12* (2006.01)
*H01Q 1/48* (2006.01)
*H01Q 9/04* (2006.01)

(52) U.S. Cl.
CPC ..... *H01Q 13/12* (2013.01); *H01Q 1/48* (2013.01); *H01Q 9/0485* (2013.01)

(58) Field of Classification Search
CPC ..... H01Q 13/12; H01Q 1/48; H01Q 9/0485
See application file for complete search history.

(56) References Cited

U.S. PATENT DOCUMENTS 10,014,584 B1 7/2018 Tonn
10,170,841 B1 * 1/2019 Tonn ..... H01Q 5/328

* cited by examiner

*Primary Examiner* — Hoang V Nguyen
(74) *Attorney, Agent, or Firm* — James M. Kasischke; Michael P. Stanley

(57) ABSTRACT

An antenna capable of being joined to an antenna feed perpendicular to a ground plane includes a conductive radiator and a circular wafer surrounding the radiator. The radiator is tubular and has a longitudinal slot along the entire length thereof, parallel to the radiator's axis. The antenna feed can be connected across the slot. The wafer, made either or a conventional high dielectric isotropic material or of a uniaxial dielectric material, is spaced apart from the radiator and has a thickness approximately equal to the width of the slot, a diameter wherein a ratio of a diameter of the radiator to the diameter of the wafer is approximately 35%, and is located at a height above the ground plane equal to approximately 35% of the length of the radiator. The material of the wafer has a dielectric tensor with high polarizability in the axial direction and can be applied to preexisting antennas. This antenna gives enhanced bandwidth over ordinary slotted antennas.

14 Claims, 6 Drawing Sheets

- PRIOR ART -

- PRIOR ART -

BROADBAND SLOTTED ANTENNA

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

CROSS REFERENCE TO OTHER PATENT APPLICATIONS

None.

BACKGROUND OF THE INVENTION

1) Field of the Invention

The present invention is directed to a slotted antenna having enhanced broadband characteristics.

2) Description of the Related Art

An antenna may be used for transmission of a signal, in which radio frequency (RF) electrical energy from a transmitter is converted to electromagnetic energy and radiates into the surrounding environment. An antenna may also be used for reception of an RF signal, in which electromagnetic energy impinging on the antenna is converted into radio frequency electrical energy and is fed to a receiver. The frequency bandwidth of the antenna depends on the size and design for a particular frequency while reception and transmission signal strength depends on the orientation of the antenna with respect to a signal path.

Slotted cylinder antennas are popular antennas for use in line-of-sight communications systems, especially where the carrier frequency exceeds 300 MHz. FIG. 1 shows a prior art slotted cylinder antenna 10. Antenna 10 includes a conductive cylinder 12 having a slot 14 in the wall of the conductive cylinder 12. The conductive cylinder 12 is typically made of copper. The conductive cylinder 12 can be any thickness as long as skin effects are avoided. The slot 14 extends the entire length of the conductive cylinder 12 and is parallel to an axis 16 of the conductive cylinder 12. Axis 16 is perpendicular to a ground plane 18. The interior of the conductive cylinder or cavity is typically filled with air, but other dielectric materials can be used.

FIG. 1 shows an end-fed version of a slotted cylinder antenna 10. In this version, a transmission line having a first conductor 20 is provided through the ground plane 18 and connected across the slot 14 near one end of the slot 14. A second conductor 22 is shown grounded to the ground plane 18. The transmission line can be either a balanced line, such as a twisted pair, or an unbalanced line, such as a length of coaxial line (shown). In either case, the transmission line must have two conductors in order to connect across slot 14.

The dimensions of the components of the slotted cylinder antenna 10 are critical to its operating frequencies. The optimal frequency of antenna 10 is given by the length of the slot 14. The size of the cavity within the conductive cylinder 12 and the width of slot 14 govern its bandwidth. As shown in FIG. 1, the conductive cylinder 12 has an inner radius r, a thickness d, and a height $h_1$. Conductive cylinder 12 is raised above the ground plane 18 by a distance $h_2$ so that it is not in contact with the ground plane 18. Slot 14 has a width w.

U.S. Pat. No. 10,014,584, to Tonn, discloses improvements to slotted cylinder antennas by providing a cylindrical shell of a uniaxial dielectric material outside and spaced apart from the conductive radiator portion of the slotted cylinder antenna. FIG. 2 shows a prior art shell 24 applied to a slotted cylinder antenna 10. The shell 24 can be made from a stack 26 of a plurality of disks positioned coaxially with the axis 16 of the slotted cylinder antenna 10. The stack 26 includes dielectric disks 28, having the necessary dielectric tensor, alternating with insulator disks 30, made of a low-k dielectric material. The shell 24 extends beyond each end of the conductive cylinder 12 and electrically contacts the ground plane 18. The shell 24 improves the bandwidth of the slotted cylinder antenna 10.

SUMMARY OF THE INVENTION

It is an object of the present invention to provide a vertically deployable antenna. A related object is to provide such a vertically deployable antenna with improved bandwidth over ordinary slotted antennas.

It is another object of the present invention to provide an apparatus that can be applied to preexisting antennas to improve the bandwidth of the antenna.

The antenna of the present invention includes a circular wafer surrounding the radiator portion of the antenna placed at a height above the ground plane equal to approximately 35% of the length of the conductive cylinder of the antenna. The thickness of the circular wafer is approximately the same as the width of the slot and the ratio of the cylinder diameter to that of the circular wafer is approximately 35%. Alternatively, two or three wafers may be used, alternated with spacers at the same height above the groundplane.

According to an embodiment of the invention, there is provided an antenna that is capable of being joined to an antenna feed perpendicular to a ground plane. The antenna includes a conductive radiator and a circular wafer surrounding the radiator. The conductive radiator is tubular and has a longitudinal slot along the entire length thereof. The slot is parallel to the axis of the conductive radiator. The antenna feed can be connected across the slot. The circular wafer is made of a uniaxial dielectric material and is provided outside and spaced apart from the conductive radiator. The circular wafer has a thickness approximately equal to the width of the slot, a diameter wherein a ratio of a diameter of the conductive radiator to the diameter of the circular wafer is approximately 35%, and is located at a height above the ground plane equal to approximately 35% of the length of the conductive radiator. The circular wafer is either made from an isotropic material having a high (>8) relative permittivity, or an anisotropic material having a dielectric tensor with high permittivity in the axial direction. This antenna gives enhanced bandwidth over ordinary slotted antennas. The circular wafer(s) can be applied to preexisting antennas. The antenna can be structurally enhanced by providing dielectric material inside the conductive radiator and between the conductive radiator and the circular wafer.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
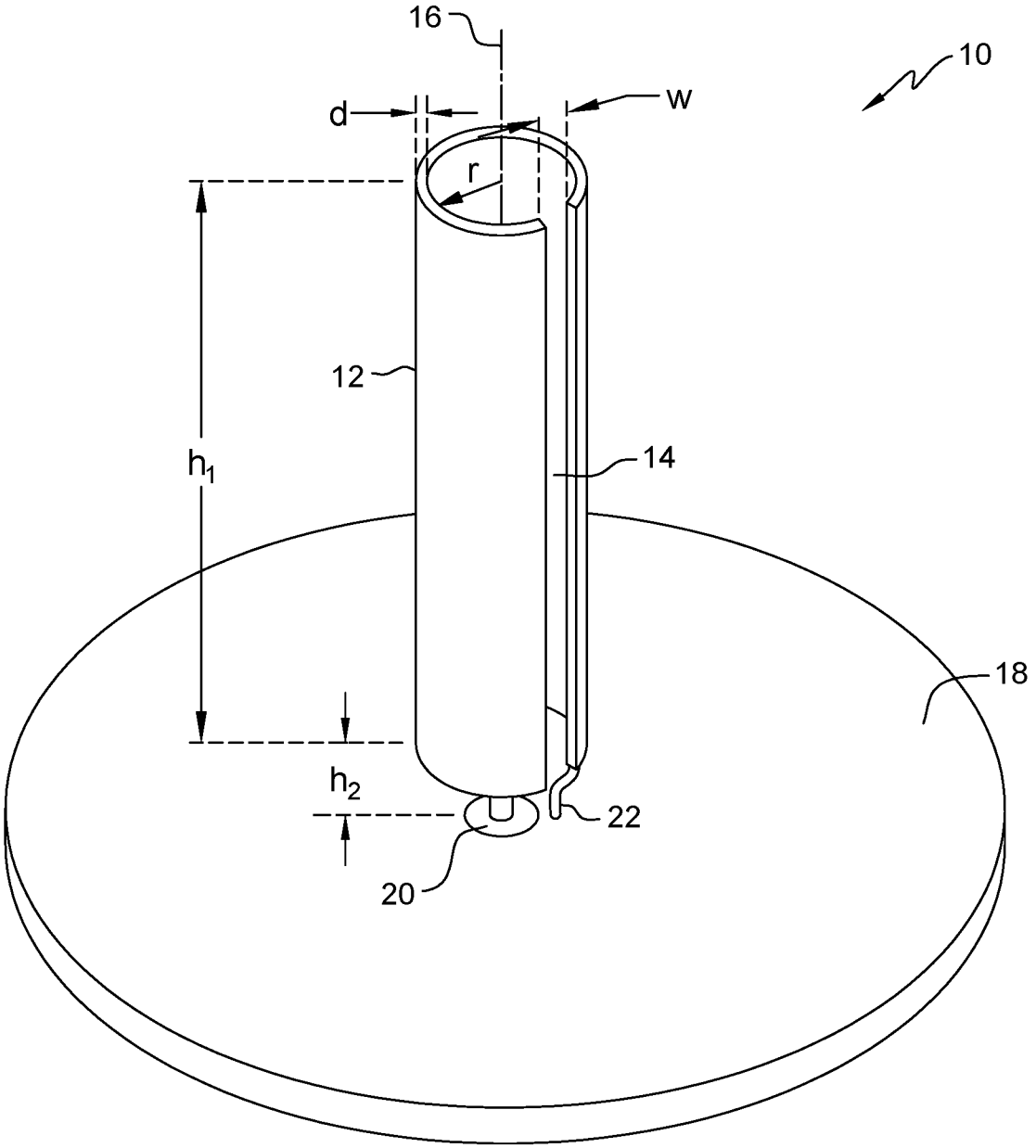
FIG. 1 is a perspective view of a prior antenna.
Figure 2:
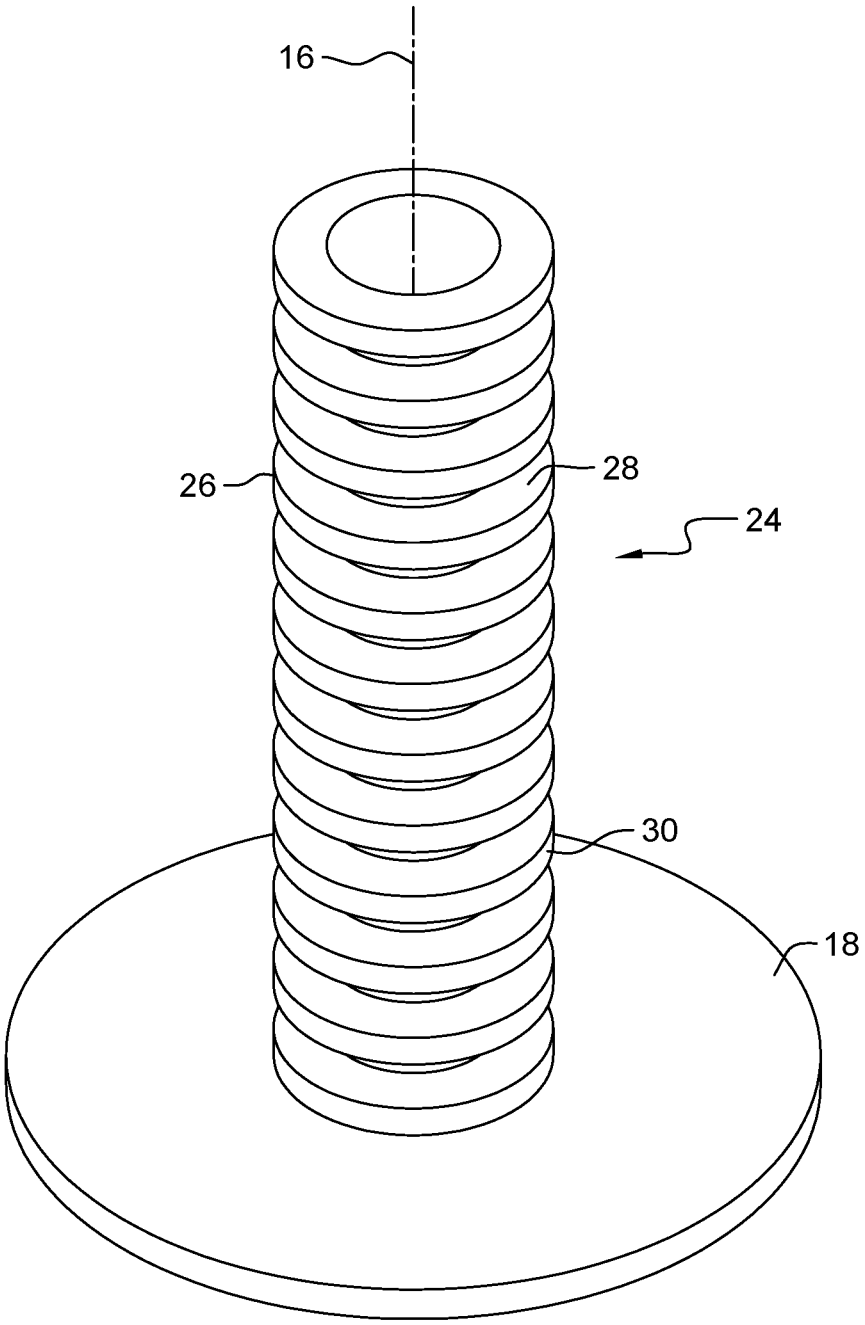
FIG. 2 is a perspective view of a prior antenna.
Figure 3:
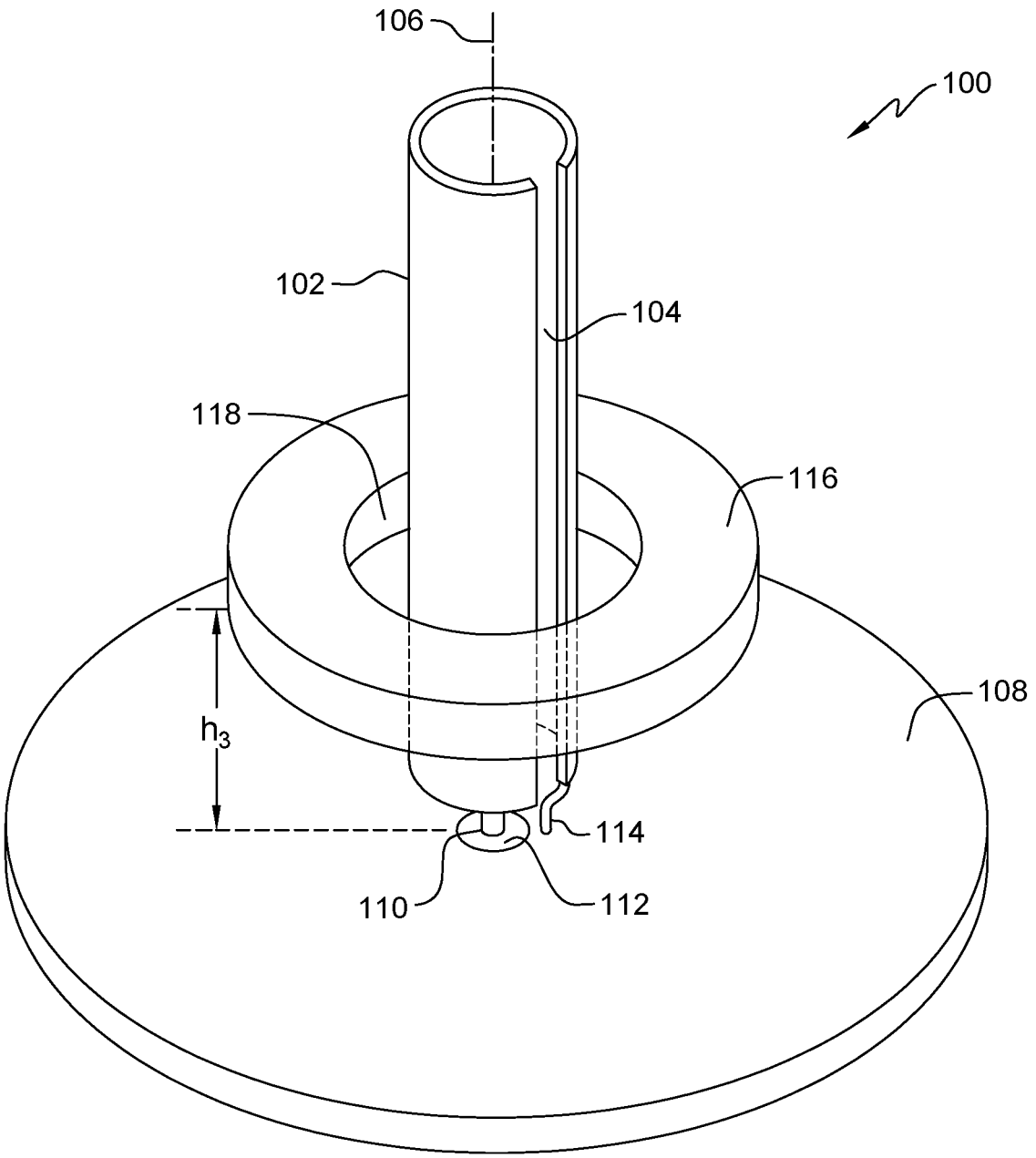
FIG. 3 is a perspective view of an antenna according to the present invention.

FIG. 3 is a perspective view of an antenna, indicated generally as 100, of the present invention. The antenna 100 includes a conductive radiator in the form of a cylinder 102 having a slot 104 formed longitudinally into the wall of the cylinder 102. The cylinder 102 is conductive and typically made of copper. The slot 104 extends the entire length of the cylinder 102 and is parallel to a longitudinal axis 106 of the cylinder 102. The cylinder 102 is perpendicular to ground plane 108. The cylinder 102 is end fed by a coaxial feed 110 including a center conductor 112 and an outer conductor 114. The center conductor 112 is insulated from the ground plane 108 and joined to the cylinder 102 at a first side of the slot 104. The outer conductor 114 is joined to the ground plane 108 and to the cylinder 102 at a second side of the slot 104, opposite the first side. A circular wafer 116 of an appropriate dielectric material is provided outside and surrounding the cylinder 102. The circular wafer 116 is located at a height, $h_3$, above the ground plane 108 equal to approximately 35% of the length of the cylinder 102.

Figure 4:
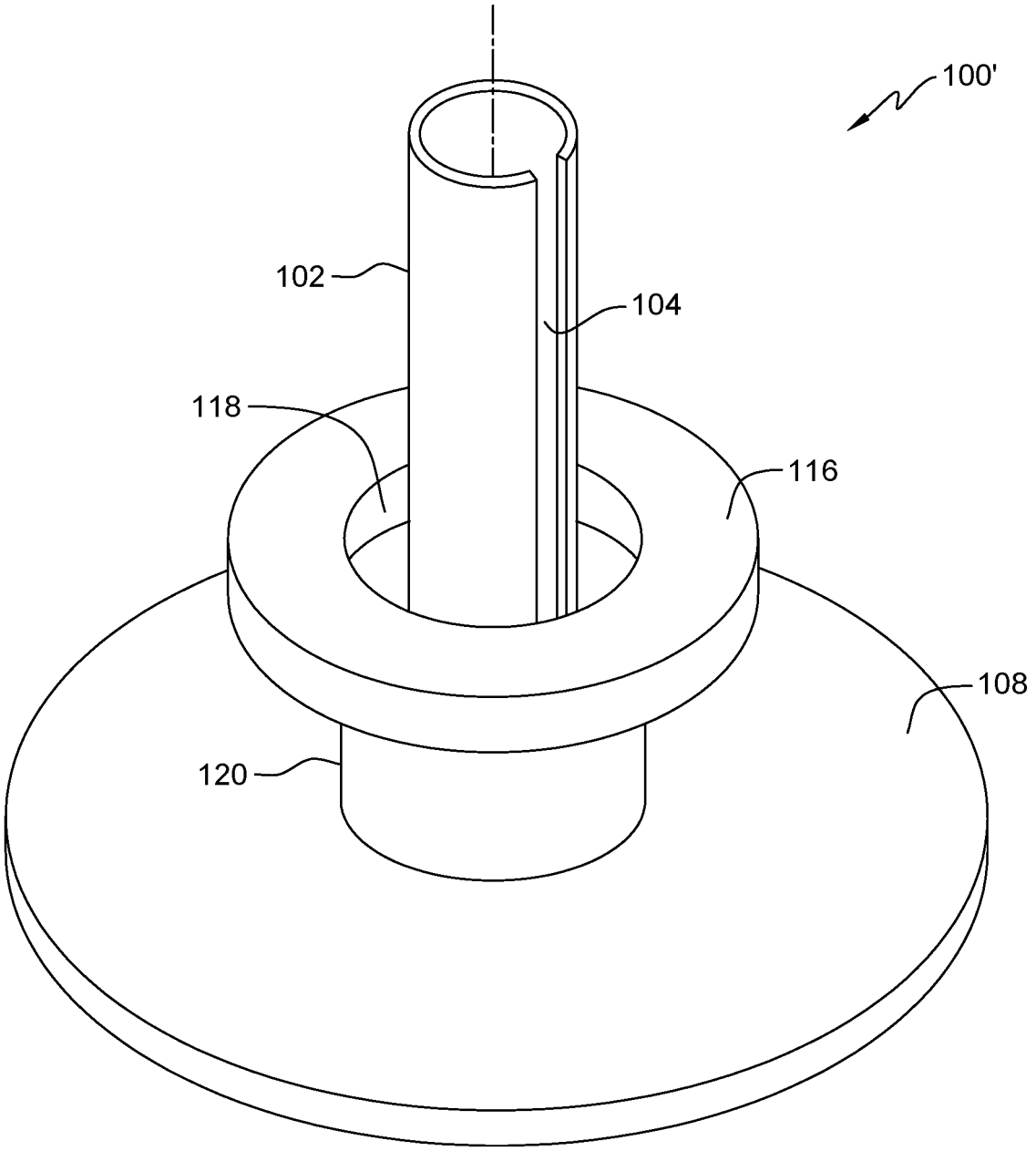
FIG. 4 is a perspective view of the antenna of FIG. 3 with a spacer.

FIG. 4 provides another embodiment 100' of the antenna. In this embodiment, the circular wafer 116 can be positioned above the ground plane 108 using a spacer 120. The spacer 120 is made of a low-k dielectric material. (Low-k refers to a material with a small dielectric constant, meaning it is a poor conductor of electricity.) Such low-k dielectric material includes a plurality of different substances, such as styrofoam, syntactic foam, and other materials having a similar dielectric constant. The spacer 120 is provided only for support of the circular wafer 116 and can be made from any rigid non-conductive material that does not influence the electromagnetic properties of the antenna 100'.

Figure 5:
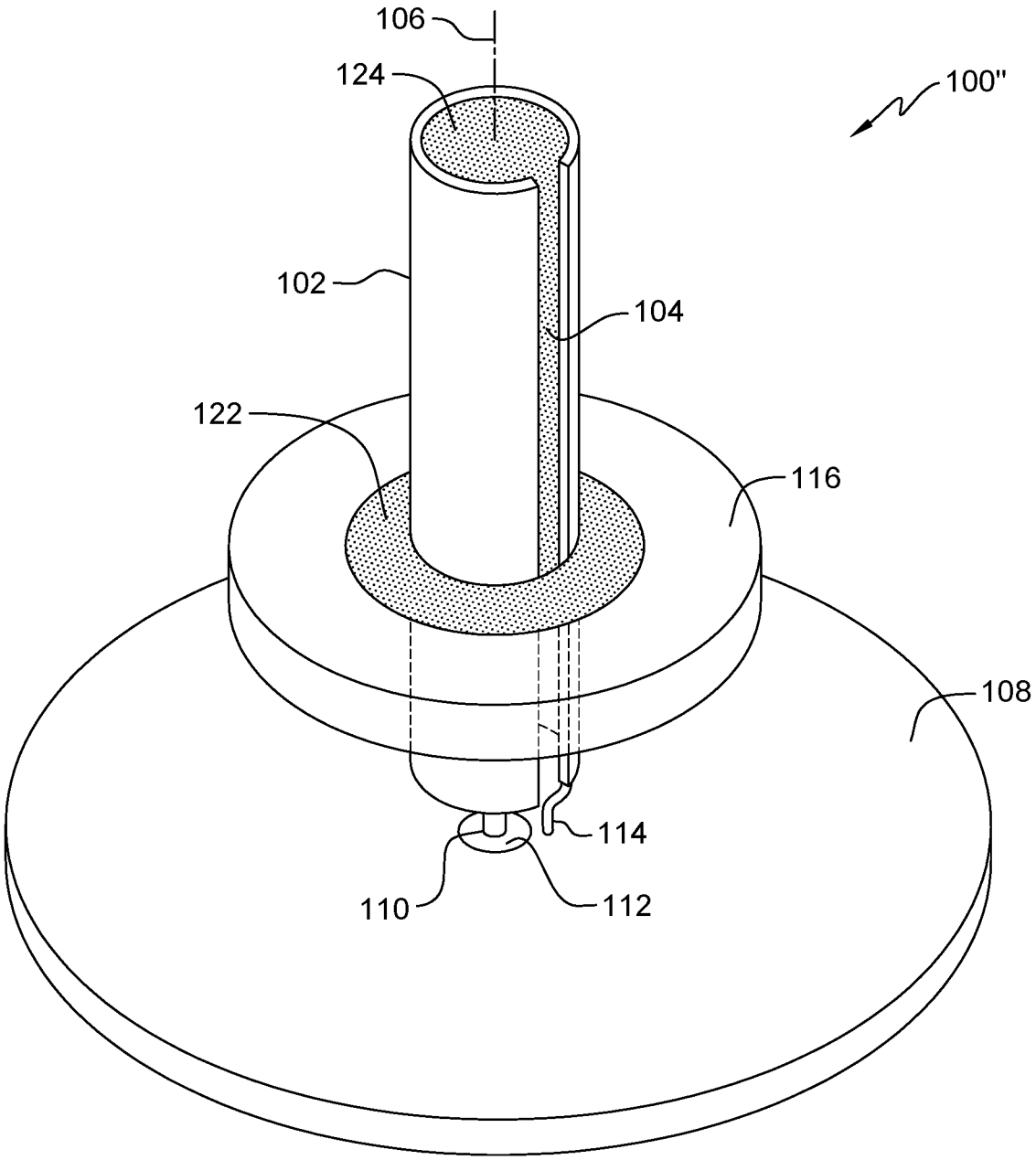
FIG. 5 is a perspective view of an alternate embodiment.

In yet another embodiment 100" shown in FIG. 5, circular wafer 116 is positioned by an offset ring 122 between wafer 116 and cylinder 102. Like spacer 120, offset ring 122 should be made from low-k dielectric material. Embodiment 100" also shows cylinder 102 being filled with dielectric material 124 for structural purposes. This is merely an example and any of the embodiments 100, 100', and 100" can be filled with dielectric material.

The circular wafer 116 is coaxial with the cylinder 102 and has an aperture 118 in the center to accommodate the cylinder 102. The circular wafer 116 is made from a dielectric material. This material is either isotropic and possesses a high relative permittivity (greater than 8 or 10) or is comprised of an anisotropic dielectric material that has a diagonal dielectric tensor where only one of the components is greater than unity. In this case, that component is in the radial direction so as to be parallel with the axis 106 of the cylinder 102 and the slot 104. The dielectric tensor $\bar{\varepsilon}$ in Cartesian coordinates is as follows:

$$\bar{\varepsilon} = \begin{pmatrix} \epsilon_{\rho\rho} & 0 & 0 \\ 0 & \epsilon_{\phi\phi} & 0 \\ 0 & 0 & \epsilon_{zz} \end{pmatrix} \quad (1)$$

where $\varepsilon_{\rho\rho}$ ranges from approximately 8 to approximately 11.

The inner diameter of the circular wafer 116 is just slightly larger than the outer diameter of the cylinder 102. The thickness of the circular wafer 116 is approximately equal to the width of the slot 104. The diameter of the circular wafer 116 is selected such that the ratio of the diameter of the cylinder 102 to the diameter of the circular wafer 116 is approximately 35%.

Design parameters for this embodiment of antenna 100 are provided in the following table:

TABLE 1

| Cylinder | |
|---|---|
| Inner radius, r | 5 mm |
| Thickness, d | 1 mm |
| Height, $h_1$ | 30 mm |
| Standoff height, $h_2$ | 5 mm |
| Slot width, w | 2 mm |
| **Circular Wafer** | |
| Inner radius | 7 mm |
| Thickness | 2 mm |
| Diameter | 28.5 mm |
| Standoff height, $h_3$ | 10.5 mm |

Construction and testing of a prototype has found that improvement in the bandwidth of the antenna 100 results from such a structure or a similar structure using two or three wafers in a position equivalent to that of the single wafer already described. Bandwidth is improved because of the interaction between the near fields of the cylinder 102 and circular wafer 116, resulting in a situation where the electric field in the slot 104 remains fairly constant over a wide range of frequencies. This improves the bandwidth.

The cutoff frequency, fc, of antenna 100 is a function of the geometry of the cylinder 102 and slot 104. In some embodiments, the slot may be filled with a dielectric material that fills the gap in cylinder 102 caused by the presence of slot 104. This dielectric loading of the slot will lower the cutoff frequency of the slot antenna as is known in the art.

The concepts of the present invention are applicable to other anisotropic dielectric structures in which the polarizability of the material is much larger in the plane perpendicular to the axis 106 of the antenna 100 than it is in the direction parallel to the axis 106. For example, some materials that can be used for the circular wafer 116 include alumina ($Al_2O_3$) and zirconium oxide ($ZrO_2$). In some cases, the circular wafer 116 can be made from a composite material engineered to have the specified dielectric tensor.

Figure 6:
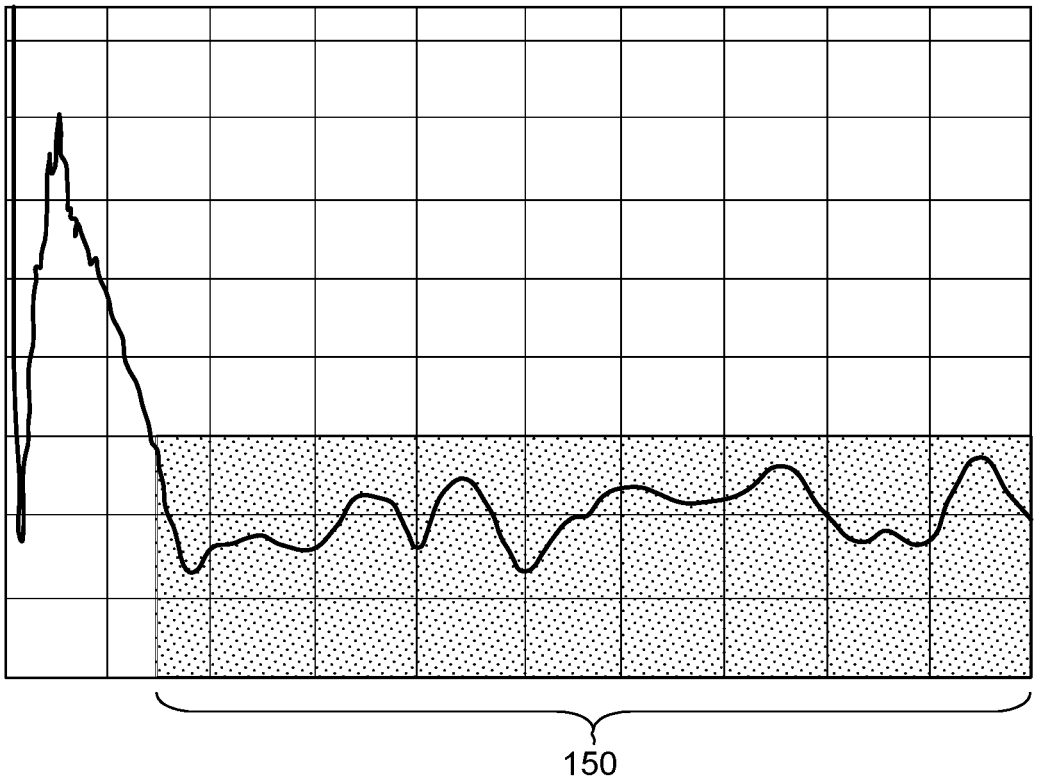
FIG. 6 is a graph of VSWR versus frequency for an antenna according to the present invention.

The Voltage Standing Wave Ratio (VSWR) is a measure of how closely matched the antenna is to a transmitter or receiver having a nominal 50-ohm impedance. A VSWR of unity is considered a perfect match but rarely met in practice. In practical terms, the VSWR also provides information about the loss in power transfer between the antenna 100 and the receiver or transmitter due to a mismatch in impedance. The computed VSWR of antenna 100 is shown in FIG. 6. Useful bandwidth occurs in region 150 identified in FIG. 6. The data indicates that the bandwidth of antenna 100 has been dramatically improved.

This antenna 100 works well when vertically mounted and fed by a coaxial line against a conductive ground plane 108. It also has a significantly improved bandwidth compared with an ordinary slotted cylinder antenna 10 that does not employ a circular wafer 116. This increase in bandwidth does not bring along an accompanying penalty in antenna realized gain.

Antenna 100 can be made by modifying existing slotted antennas by retrofitting these antennas with a uniaxial circular wafer having the above-described physical properties. This will improve the bandwidth of the existing antenna and allow greater flexibility. The antenna can be structurally enhanced by filling the region within cylinder 102 with a low-k dielectric material. This material can be a substantially solid dielectric material, such as syntactic foam or other material that does not affect the electromagnetic properties of the antenna. Likewise, the region between the cylinder 102 and the circular wafer 116 can also be filled with a substantially solid dielectric material, such as a PVC spacer or a syntactic foam.

The invention has been described with references to specific embodiments. While particular values, relationships, materials, and steps have been set forth for purposes of describing concepts of the present disclosure, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present disclosure, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

Finally, any numerical parameters set forth in the specification and attached claims are approximations (for example, by using the term "about") that may vary depending upon the desired properties sought to be obtained by the present disclosure. At the very least, and not as an attempt to limit the application of the doctrine of equivalents to the scope of the claims, each numerical parameter should at least be construed in light of the number of significant digits and by applying ordinary rounding.

What is claimed is:

1. An antenna capable of being joined to an antenna feed perpendicular to a ground plane comprising:

a conductive radiator being substantially tubular and having a slot formed therein from a first end of said conductive radiator to a second end of said conductive radiator, the slot being parallel to an axis of said conductive radiator, the antenna feed being connectable to said conductive radiator adjacent to and across the slot; and a circular wafer surrounding said conductive radiator and spaced apart therefrom, said circular wafer having a thickness approximately equal to a width of the slot, having a diameter wherein a ratio of a diameter of said conductive radiator to the diameter of said circular wafer is approximately 35%, and being positioned at a height above the ground plane equal to approximately 35% of a length of said conductive radiator from the first end of said conductive radiator to the second end of said conductive radiator.

2. The apparatus of claim 1, wherein said circular wafer is made from an isotropic material having a dielectric constant greater than about 8.

3. The apparatus of claim 2, wherein said circular wafer is formed from an engineered composite material having the specified dielectric constant.

4. The apparatus of claim 1, further comprising a spacer disposed between said circular wafer and said ground plane.

5. The apparatus of claim 4, wherein the spacer is made from a low-k dielectric material.

6. The apparatus of claim 1, further comprising a substantially solid dielectric material disposed in the interior of said conductive radiator.

7. The apparatus of claim 6, wherein the substantially solid dielectric material is a syntactic foam having the required dielectric properties.

8. The apparatus of claim 1, further comprising a substantially solid dielectric material disposed between said conductive radiator and said circular wafer.

9. The apparatus of claim 8, wherein the substantially solid dielectric material is a syntactic foam having the required dielectric properties.

10. The apparatus of claim 1, wherein said circular wafer is made from a material having a dielectric tensor in right cylindrical coordinates of the form:

$$\bar{\varepsilon} = \begin{pmatrix} \epsilon_{\rho\rho} & 0 & 0 \\ 0 & \epsilon_{\phi\phi} & 0 \\ 0 & 0 & \epsilon_{zz} \end{pmatrix}$$

wherein $\epsilon_{op}$ is greater than about 8 and the $\epsilon_{\phi\phi}$ and $\epsilon_{zz}$ terms are near unity, the axis of the circular wafer being coincident with the z axis of the right cylindrical coordinate system used to express the tensor.

11. The apparatus of claim 10, wherein said circular wafer is formed from an engineered composite material having the specified dielectric tensor.

12. An apparatus for improving the bandwidth of a slotted cylindrical antenna vertically disposed over a ground plane comprising:

a circular wafer of a uniaxial dielectric material surrounding a conductive radiator of the slotted cylindrical antenna and spaced apart therefrom, said circular wafer having a thickness approximately equal to a width of a slot formed in the conductive radiator, having a diameter wherein a ratio of a diameter of the conductive radiator to the diameter of said circular wafer is approximately 35%, and being at a height above the ground plane equal to approximately 35% of a length of the conductive radiator from a first end of the conductive radiator to a second end of the conductive radiator, the uniaxial dielectric material having a dielectric tensor having high impedance in the direction parallel to the axis of the conductive radiator.

13. The apparatus of claim 12, wherein said circular wafer is made from a material having a dielectric tensor in right cylindrical coordinates of the form:

$$\bar{\varepsilon} = \begin{pmatrix} \in_{\rho\rho} & 0 & 0 \\ 0 & \in_{\phi\phi} & 0 \\ 0 & 0 & \in_{zz} \end{pmatrix}$$

wherein $\in_{op}$ is greater than about 8 and the $\in_{\phi\phi}$ and $\in_{zz}$ terms are near unity, the axis of the circular wafer being coincident with the z axis of the right cylindrical coordinate system used to express the tensor.

14. The apparatus of claim 13, wherein said circular wafer is formed from an engineered composite material having the specified dielectric tensor.

* * * * *